US010527983B2

(12) United States Patent
Fujita et al.

(10) Patent No.: US 10,527,983 B2
(45) Date of Patent: Jan. 7, 2020

(54) IMAGE FORMING METHOD AND IMAGE FORMING DEVICE

(71) Applicant: Konica Minolta Inc., Tokyo (JP)

(72) Inventors: Michiyo Fujita, Hachioji (JP); Makoto Nomiya, Tokyo (JP); Tomomi Oshiba, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/172,101

(22) Filed: Oct. 26, 2018

(65) Prior Publication Data

US 2019/0155197 A1 May 23, 2019

(30) Foreign Application Priority Data

Nov. 21, 2017 (JP) ..... 2017-223788

(51) Int. Cl.
*G03G 15/20* (2006.01)
*G03G 15/00* (2006.01)

(52) U.S. Cl.
CPC ..... *G03G 15/2053* (2013.01); *G03G 15/6585* (2013.01); *G03G 15/6591* (2013.01); *G03G 2215/00021* (2013.01); *G03G 2215/00801* (2013.01)

(58) Field of Classification Search
CPC ..... G03G 15/1695; G03G 15/2053
See application file for complete search history.

(56) References Cited

U.S. PATENT DOCUMENTS

2008/0145084 A1* 6/2008 Toizumi ..... G03G 15/08 399/66
2011/0255886 A1* 10/2011 Kwak ..... G03G 15/0853 399/27
2012/0202021 A1* 8/2012 Schulze-Hagenest ... G03G 8/00 428/207
2015/0370194 A1* 12/2015 Kiuchi ..... G03G 15/0822 399/390
2016/0187824 A1* 6/2016 Sato ..... B31D 1/027 399/38

FOREIGN PATENT DOCUMENTS

JP H01200985 A 8/1989
JP 2014157249 A 8/2014

* cited by examiner

*Primary Examiner* — Gregory H Curran
(74) *Attorney, Agent, or Firm* — Lucas & Mercanti, LLP

(57) ABSTRACT

An image forming method includes: supplying a powder onto a recording medium; supplying a coated toner onto the powder on the recording medium; and fixing the powder to the recording medium by heating the coated toner supplied onto the powder and melting the coated toner.

18 Claims, 4 Drawing Sheets

IMAGE FORMING METHOD AND IMAGE FORMING DEVICE

The entire disclosure of Japanese patent Application No. 2017-223788, filed on Nov. 21, 2017, is incorporated herein by reference in its entirety.

BACKGROUND

Technological Field

The present invention relates to an image forming method and an image forming device.

Description of the Related Art

In recent years, demands for special color printing and high added value printing are increasing in an on-demand printing market. Above all, demands for metallic printing and pearl printing are particularly large, and various studies have been performed.

As one of the methods, a method for transferring a metal foil and a resin foil using a toner as an adhesive layer has been studied. For example, a method for forming a toner image and bonding a transfer foil only to a toner portion is known (for example, refer to JP 01-200985 A). This method has a problem that in a case where a foil is transferred only to a part of an image, all the remaining parts of the foil are wasted.

Meanwhile, studies have also been performed to add a brilliant pigment to a toner. For example, a method for forming a metallic image only on a necessary part by inclusion of a brilliant pigment in a toner is known (for example, refer to JP 2014-157249 A). However, with this method, there may be a case where a metallic feeling and a pearl feeling required cannot be obtained.

SUMMARY

An object of the present invention is to provide a novel technique for forming an image having a metallic tone at a desired position.

To achieve the abovementioned object, according to an aspect of the present invention, an image forming method reflecting one aspect of the present invention comprises: supplying a powder onto a recording medium; supplying a coated toner onto the powder on the recording medium; and fixing the powder to the recording medium by heating the coated toner supplied onto the powder and melting the coated toner.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
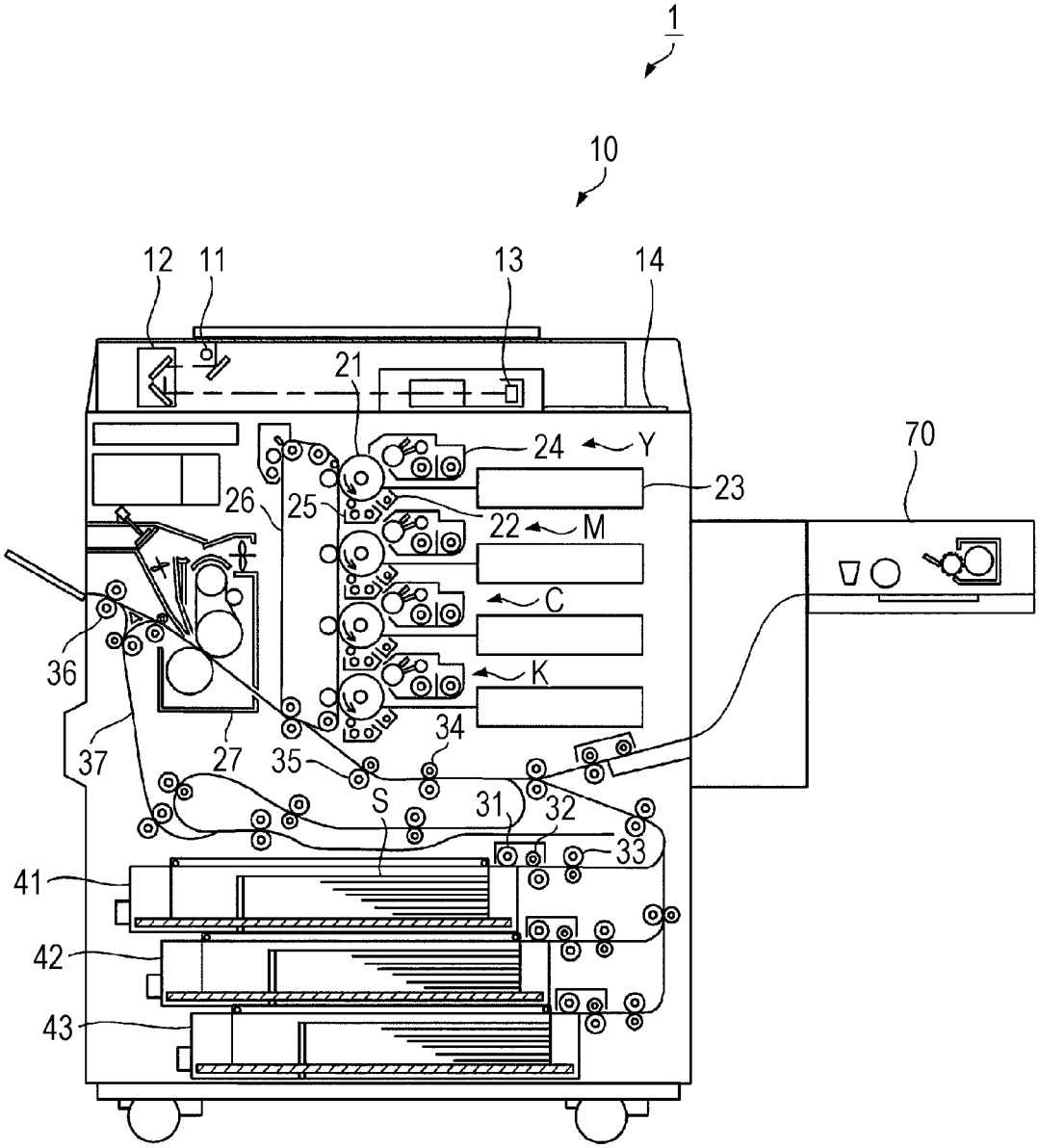
FIG. 1 is a view illustrating the configuration of an image forming device according to an embodiment of the present invention.

Hereinafter, one or more embodiments of the present invention will be described with reference to the drawings. However, the scope of the invention is not limited to the disclosed embodiments.

(Image Forming Method)

An image forming method according to the present embodiment includes a step of supplying a powder onto a recording medium, a step of supplying a coated toner onto the powder on the recording medium, and a step of fixing the powder to the recording medium by heating the coated toner supplied onto the powder and melting the coated toner. The image forming method according to the present embodiment may further include a step of forming a resin image on a recording medium and a step of collecting a powder before the step of supplying a powder.

In the step of supplying a powder onto a recording medium, a powder is supplied to a region (powder supply region) to which a powder on a recording medium is to be supplied. A method for supplying a powder onto a recording medium can be selected appropriately. Examples of a method for supplying a powder to a powder supply region of a recording medium include a method using a powder supply device described later and a method for scattering a powder with a sieve.

The recording medium can be appropriately selected from objects capable of carrying a powder and a coated toner. Examples of the recording medium include plain paper from thin paper to thick paper, high quality paper, coated printing paper such as art paper or coated paper, commercially available Japanese paper or postcard paper, a plastic film, and a cloth. For example, it is only required to appropriately select the color of the recording medium depending on a final image to be formed.

The powder can be appropriately selected as long as the powder can develop a metallic tone or a pearl tone as a desired appearance in a final image. The powder is a powdery substance different from a coated toner. As the physical characteristics of the powder, it is necessary for the powder not to melt even at a temperature at which the coated toner melts and not to have adhesion to the recording medium.

A covering ratio by the powder with respect to the powder supply region is preferably 40 to 90%. If the covering ratio by the powder with respect to the powder supply region is within the above range, a desired appearance can be imparted to a final image.

The powder may have any shape. Note that the powder preferably has a non-spherical shape, and preferably has a flat shape from a viewpoint of orienting and attaching the powder along a surface of the recording medium. Here, "non-spherical shape" means a shape that is not a true sphere. The "flat shape" means a shape in which a ratio of a short diameter with respect to a thickness is five or more when a minimum length of the powder passing through the center of gravity of the powder in a plan view of the powder is defined as a short diameter, a maximum length of the powder passing through the center of gravity of the powder in a plan view of the powder is defined as a long diameter, and a minimum length in a direction orthogonal to the long diameter and the short diameter is defined as a thickness.

The powder preferably contains a metal powder. The content of the metal powder in the powder is preferably 2 to 100% by mass. The metal powder includes a metal powder sandwiched by glass, resin, or the like, a metal powder vapor-deposited or wet coated on a surface of glass, resin, or the like, and a metal powder vapor-deposited or wet coated on one surface of glass, resin, or the like.

The thickness of the powder is preferably 0.2 to 15 μm from a viewpoint of obtaining a desired appearance when the powder is properly oriented. In a case where the thickness of the powder is too small, a planar direction of the powder does not match the surface direction of the recording medium, and there is a risk that the powder will not be oriented favorably. Meanwhile, in a case where the thickness of the powder is too large, the powder may be removed in a step of rubbing the powder.

The powder may be a synthetic product or a commercially available product. Examples of the powder include Sunshine Babe chromium powder, aurora powder, and pearl powder (all manufactured by GG Corporation), ICEGEL mirror metal powder (manufactured by TAT Corporation), Pica-Ace MC shine dust, Effect C (manufactured by Kurachi Corporation, "Pika-Ace" is a registered trademark of Kurachi Corporation), PREGEL magic powder, mirror series (manufactured by Preanfa Limited, "PREGEL" is a registered trademark of Preanfa Limited), Bonnail shine powder (manufactured by K's Planning Inc., "BON NAIL" is a registered trademark of K' Planning Inc.), Metashine (manufactured by Nippon Sheet Glass Co., Ltd., "Metashine" is a registered trademark of Nippon Sheet Glass Co., Ltd.), and ELgee neo (manufactured by Oike & Co., Ltd.).

In the step of supplying a coated toner onto a powder on a recording medium, the coated toner is supplied to a powder supply region so as to cover the powder disposed in the powder supply region. A method for supplying a coated toner can be appropriately selected. Examples of the method for supplying a coated toner include a method using a toner supply device described later and a method for scattering a coated toner with a sieve.

The coated toner is disposed so as to cover a powder, melts by being heated, and fixes the powder on a recording medium to the recording medium. The coated toner is a powdery substance different from a powder. As the coated toner, a color toner used in a general full-color image forming device or the like can be used. The coated toner is an aggregate of toner particles including toner base particles and an external additive. The toner base particles contain a binder resin and a colorant.

The coated toner includes a colored transparent toner such as a yellow toner, a cyan toner, or a magenta toner, and a colorless transparent toner such as a clear toner. As described above, in a case where the coated toner is a colored transparent toner or a colorless transparent toner, even in a case where an image by a coated toner is formed on a powder, a metallic feeling due to the powder is not impaired. The metallic feeling can be adjusted widely from a metallic feeling with high glossiness to a metallic feeling with low glossiness (matte metallic). Even in a case where an opaque toner such as a black toner or a white toner is used, the opaque toner can be used without impairing a metallic feeling depending on the concentration of the coated toner. As described above, since the covering ratio by the powder with respect to the powder supply region on the recording medium is 90% or less, the powder can be properly fixed to the recording medium.

(Method for Manufacturing Coated Toner)

Here, a method for manufacturing a coated toner will be described. The coated toner used in the present embodiment can be manufactured, for example, by obtaining toner particles using a binder resin, a colorant, and, if necessary, an internal additive, and adding, if necessary, an external additive to the toner particles.

Examples of the method for manufacturing a coated toner include an emulsion aggregation method, a pulverization method, a suspension polymerization method, and other known methods. Note that the method for manufacturing a coated toner is preferably the emulsion aggregation method from viewpoints of manufacturing cost, manufacturing stability, and reducing the sizes of toner particles.

Here, the "emulsion aggregation method" is a method for manufacturing toner particles by mixing a dispersion of fine particles of a binder resin (hereinafter also referred to as "binder resin fine particles") manufactured by an emulsion polymerization method with a dispersion of fine particles of a colorant (hereinafter also referred to as "colorant fine particles"), aggregating the fine particles until a desired toner particle diameter is reached, and further fusing the binder resin fine particles to control the shapes. Here, the fine particles of the binder resin may optionally contain a release agent, a charge control agent, and the like.

An example of a case where the emulsion aggregation method is used as the method for manufacturing a coated toner will be described below.

The method for manufacturing a coated toner by the emulsion aggregation method includes:

(1) a step of preparing a dispersion in which colorant fine particles are dispersed in an aqueous medium;

(2) a step of preparing a dispersion in which binder resin fine particles containing, if necessary, an internal additive are dispersed in an aqueous medium;

(3) a step of mixing the dispersion of the colorant fine particles and the dispersion of the binder resin fine particles, and aggregating, associating, and fusing the colorant fine particles and the binder resin fine particles to form toner particles;

(4) a step of filtering the toner particles from the dispersion system (aqueous medium) of the toner particles to remove a surfactant or the like;

(5) a step of drying the toner particles; and (6) a step of adding an external additive to the toner particles.

In a case where a toner is manufactured by the emulsion aggregation method, a binder resin fine particle obtained by the emulsion polymerization method may have a multilayer structure of two or more layers constituted by binder resins having different compositions. A binder resin fine particle having such a configuration, for example, a binder resin fine particle having a two-layer structure can be obtained by preparing a dispersion of resin particles by an emulsion polymerization treatment (first stage polymerization) according to an ordinary method, adding a polymerization initiator and a polymerizable monomer to this dispersion, and subjecting this system to a polymerization treatment (second stage polymerization).

A toner particle having a core-shell structure is also obtained by the emulsion aggregation method. Specifically, in order to obtain the toner particle having a core-shell structure, first, binder resin fine particles and colorant fine particles for core particles are aggregated, associated, and fused to prepare core particles. Subsequently, binder resin fine particles for a shell layer are added to the dispersion of the core particles, and the binder resin fine particles for a shell layer are aggregated and fused on a surface of each of the core particles to form a shell layer covering the surface of each of the core particles.

An example of a case where the pulverization method is used as the method for manufacturing a toner will be described below.

The method for manufacturing a coated toner by the pulverization method includes:

(1) a step of mixing a binder resin, a colorant, and, if necessary, an internal additive using a Henschel mixer or the like;

(2) a step of kneading the resulting mixture while heating the mixture with an extrusion kneader or the like;

(3) a step of coarsely pulverizing the resulting kneaded product with a hammer mill or the like and then further pulverizing the resulting product with a turbo mill pulverizer or the like;

(4) a step of finely classifying the resulting pulverized product, for example, using an airflow classifier utilizing a Coanda effect to form toner particles; and (5) a step of adding an external additive to the toner particles.

The coated toner can be used as a non-magnetic one-component developer, but may be mixed with a carrier and used as a two-component developer. Note that the black toner can also be used as a magnetic one-component developer.

Examples of the carrier in a case of use as a two-component developer include magnetic particles formed of a conventionally known material, for example, a ferromagnetic metal such as iron, an alloy formed of a ferromagnetic metal and aluminum or lead, or a ferromagnetic metal compound such as ferrite or magnetite. Examples of the carrier include a coated carrier in which surfaces of magnetic particles are coated with a coating agent such as a resin and a binder type carrier in which a magnetic fine powder is dispersed in a binder resin. Examples of a coating resin constituting the coated carrier include an olefin-based resin, a styrene-based resin, a styrene-acrylic resin, a silicone-based resin, an ester resin, and a fluorocarbon resin. Examples of a resin constituting the resin dispersion type carrier include a styrene-acrylic resin, a polyester resin, a fluorocarbon resin, and a phenolic resin.

In the step of fixing the powder to the recording medium by heating the coated toner supplied onto the powder and melting the coated toner, first, the coated toner is melted by heating the coated toner. At this time, the powder is covered with the molten coated toner. Then, by cooling the molten coated toner, the powder having no adhesion to the recording medium is fixed to the recording medium. Note that pressurization may be performed simultaneously with heating of the coated toner from a viewpoint of adhesiveness between the recording medium and the coated toner. Note that the image by a coated toner is preferably formed by a dry electrophotographic method from a viewpoint of the supply amount of the coated toner.

Through the above steps, a surface of the recording medium can be adjusted so as to have a metallic tone or a pearl tone.

Incidentally, as described above, prior to the step of supplying a powder, a step of forming a resin image on a recording medium may be included. The resin image can be formed by a known image forming method such as a thy or wet electrophotographic method or an inkjet method, but is preferably formed by the dry electrophotographic method from viewpoints of the thickness of the resin image and affinity with the coated toner. The resin image is preferably formed by the dry electrophotographic method. In this case, the coated toner is placed on the resin image.

The resin used for the resin image can be appropriately selected from various known thermoplastic resins. Examples of the thermoplastic resins include a styrene-based resin, a (meth)acrylic resin, a styrene-(meth)acrylic copolymer resin, a vinyl-based resin such as an olefin-based resin, a polyester resin, a polyamide-based resin, a carbonate resin, a polyether, and a polyvinyl acetate-based resin. Preferably, the styrene-based resin, the acrylic resin, or the polyester resin is preferable. The above-described thermoplastic resins may be used singly or in combination of two or more kinds thereof.

As described above, the step of collecting a powder may be further included. The step of collecting a powder is performed after the step of supplying a powder and before the step of supplying a coated toner, and collects a surplus of the powder.

The step of supplying a powder may include a step of placing a powder on a softened resin image disposed on a recording medium and a step of rubbing the placed powder.

In the step of placing a powder on a softened resin image, first, the resin image formed on the recording medium as described above is softened. A method for softening a resin image can be appropriately selected. Examples of the method for softening a resin image include heating. Then, a powder is supplied to a surface of the softened resin image. Finally, the placed powder is rubbed. Here, "rubbing" means moving the powder relative to a layer on the recording medium along a surface of the layer while the powder is in contact with the surface. Rubbing is preferably accompanied by pressing from viewpoints of orienting a non-spherical powder on the surface of the layer and strengthening adhesion of the powder to the layer. "Pressing" means pressing the surface of the layer in a direction crossing the surface of the layer (for example, vertical direction). This makes it possible to attach the powder to the surface of the resin image and to remove a surplus of the powder.

In the step of rubbing a powder, the powder is preferably rubbed in a state where a straight line in a conveyance direction of the recording medium crosses a straight line in a long axis direction of a rubbing member that rubs the powder. As a result, the powder can be rubbed properly.

In the step of rubbing a powder, the rubbing member is preferably reciprocated in an orientation direction of the powder. As a result, the orientation direction of the powder is aligned, and therefore the appearance of a final image can be favorable.

(Configuration of Image Forming Device)

The above-described image forming method can be performed, for example, with the following image forming device.

An image forming device 1 includes a powder supply device 70, a toner supply device, and a fixing device.

As the powder supply device 70, a known device can be used depending on the properties of a powder as long as being able to supply the powder onto a recording medium S. As the powder supply device 70, for example, a powder supply means described in JP 2013-178452 A can be used.

As the toner supply device, a known device can be used depending on the properties of a coated toner as long as being able to supply the coated toner onto a powder. In the present embodiment, an example will be described in which image forming units Y, M, C, and K mounted on a general toner image forming device 10 are used as the toner supply device.

As the fixing device, a known device can be used as long as being able to fix a powder and a coated toner on the recording medium S. In the present embodiment, an example will be described in which a fixing unit mounted on the general toner image forming device 10 is used.

Furthermore, a resin image may be formed on the recording medium (sheet) S, or nothing has to be formed on the recording medium S. In the present embodiment, nothing is formed on the recording medium S.

In the following description, an example will be described in which the powder supply device 70 and the toner image forming device 10 are included as the image forming device.

Figure 2:
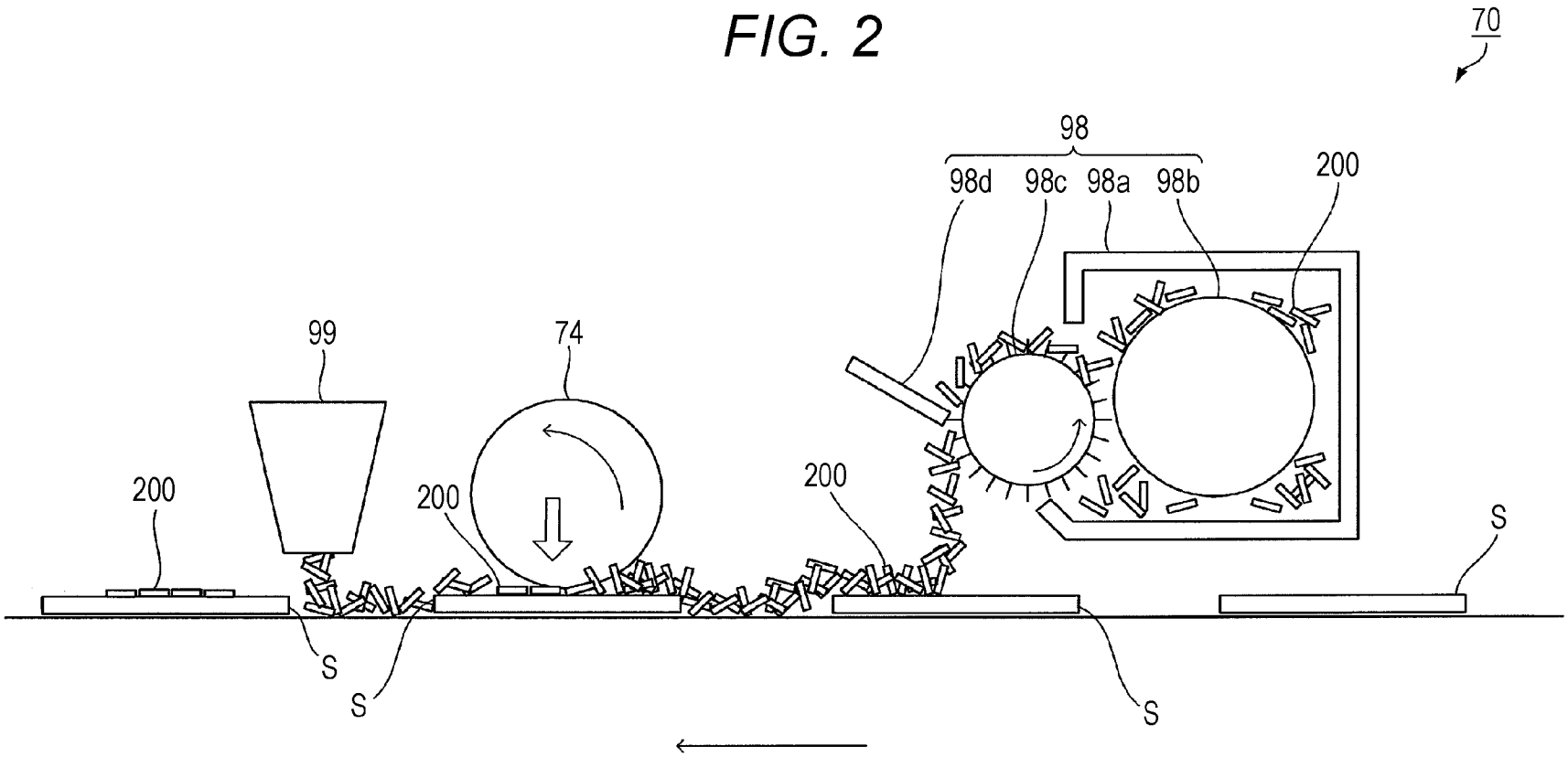
FIG. 2 is a view illustrating the configuration of a powder supply device.
Figure 3A:
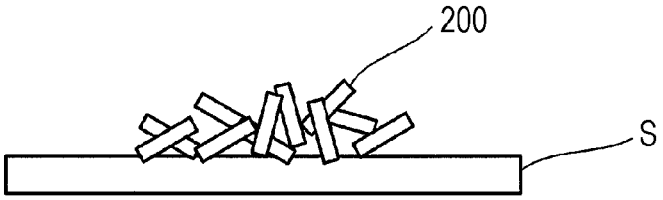
FIGS. 3A and 3B are schematic views illustrating how a powder is rubbed.
Figure 3B:
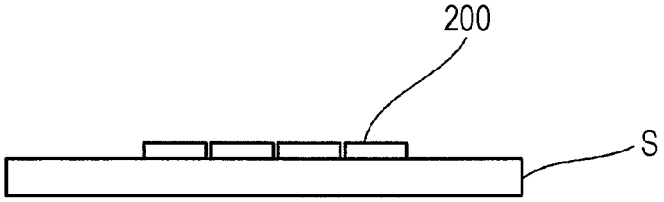

FIG. 1 is a schematic view of the image forming device 1 according to the present embodiment. FIG. 2 is a schematic view illustrating the configuration of the powder supply device 70. FIGS. 3A and 3B are schematic views illustrating how a powder is rubbed. As illustrated in FIG. 1, the image forming device 1 includes the powder supply device 70, a toner supply device, and a fixing device. As illustrated in FIG. 2, the powder supply device 70 includes a rubbing roller 74, a powder supply unit 98, and a coating material powder collecting unit 99.

The powder supply unit 98 is a device for supplying a powder 200 onto the recording medium S as a means for supplying the powder 200. The powder supply unit 98 includes a container 98*a* for containing the powder 200, a conveying screw 98*b* for conveying the powder 200 to an opening of the container 98*a*, a brush roller 98*c* for taking out the powder 200 from the container 98*a*, and a flicker 98*d* for flipping off the powder 200 held by the brush roller 98*c*. The powder 200 has the above-described flat particle shape.

In order to regulate the amount of the powder 200 held by the brush roller 98*c*, the opening of the container 98*a* is formed so as to have a size with which the opening comes into contact with a tip of a brush of the brush roller 98*c*. The flicker 98*d* is a plate-shaped member and is disposed at a position in contact with the brush roller 98*c*. The biting amount of the flicker 98*d* into the brush roller 98*c* can be determined by considering, for example, the supply amount of the powder 200 or uneven wear of the brush. The brush bristle length and the brush density of the brush roller 98*c* can be determined by considering, for example, the supply amount of the powder 200 and drop thereof.

The flicker 98*d* may be fixed at a position in contact with the brush roller 98*c*, but the flicker 98*d* may be movable such that the flicker 98*d* is separated from the brush roller 98*c* when the brush roller 98*c* stops.

The rubbing roller 74 has a rotation axis in a direction perpendicular to a conveying direction of the recording medium S (direction perpendicular to a sheet surface), is rotatable in the direction of the arrow in the drawing, and is biased by a biasing member (not illustrated). The rubbing roller 74 includes, for example, a cylindrical core metal and an elastic layer such as a resin sponge disposed on an outer peripheral surface of the core metal. The axial length of the rubbing roller 74 is longer than the width of the recording medium S.

The coating material powder collecting unit 99 is, for example, a powder collector for sucking a surplus of the powder 200 supplied from the powder supply unit 98. The powder collector is disposed such that a suction port opens at a position at an appropriate height from a conveying path of the recording medium S, and operates, for example, at a moderate output at which the powder collector sucks the powder 200 but does not suck the recording medium S.

The toner image forming device 10 has a similar configuration to that of a known color printer, and includes, for example, an image reading unit, an image forming unit, a recording medium conveying unit, a sheet feeding unit, a control unit, and a fixing unit 27.

The image reading unit includes a light source 11, an optical system 12, an imaging element 13, and an image processing unit 14.

The image forming unit includes the image forming unit Y that forms an image formed of a yellow (Y) toner, the image forming unit M that forms an image formed of a magenta (M) toner, the image forming unit C that forms an image formed of a cyan (C) toner, the image forming unit K that forms an image formed of a black (K) toner, and an intermediate transfer belt 26. Note that each of Y, M, C and K represents a color of a toner.

The image forming unit Y includes a photosensitive drum 21 as a rotating body, and a charging unit 22, an optical writing unit 23, a developing device 24, and a drum cleaner 25 disposed around the photosensitive drum 21. Each of the image forming units M, C, and K also has the same configuration as the image forming unit Y. The intermediate transfer belt 26 is wound around a plurality of rollers and supported so as to be able to travel.

The recording medium conveying unit includes a feeding roller 31, a separating roller 32, a conveying roller 33, a loop roller 34, a resist roller 35, a sheet discharging roller 36, and a sheet inverting unit 37. The sheet feeding unit includes a plurality of sheet feeding trays 41, 42, and 43 each containing the recording medium S.

The control unit includes a central processing unit (CPU), a random access memory (RAM), and a read only memory (ROM). The CPU controls the image reading unit, the image forming unit, the recording medium conveying unit, the sheet feeding unit, and a surface treatment device according to a program stored in the ROM, and stores a calculation result and the like in the RAM. The control unit analyzes print data received from the outside, generates image data in a bitmap format, and performs control for forming an image based on the image data on the recording medium S.

The powder supply unit 98 supplies a powder to the powder supply region of the recording medium S conveyed by the powder supply device 70. In the powder supply unit 98, the conveying screw 98*b* conveys the powder 200 contained in the container 98*a* to the brush roller 98*c*. The brush roller 98*c* rotates, for example, counterclockwise and captures the powder 200. The powder 200 captured by the brush roller 98*c* is flipped off by the flicker 98*d* and supplied onto the recording medium S.

The rubbing roller 74 is biased toward the recording medium S and rotates in the direction of the arrow in the drawing. The rubbing roller 74 rotates in the opposite direction to the conveying direction of the recording medium S. The rubbing roller 74 rotates while pressing the powder 200 on a resin image 100 with a moderate force (for example, about 10 kPa). Therefore, a surface of the rubbing roller 74 rubs a surface of the recording medium S to which the powder 200 has been supplied. As a result, the powder 200 is arranged and attached to the surface of the recording medium S in a direction along this surface.

Note that a surplus of the powder 200 existing outside the powder supply region on the recording medium S is sucked by the powder collector due to a flow of air by the powder collector, and is removed from the recording medium S and the conveying path.

In this way, the powder 200 falls on the surface of the recording medium S due to rubbing, and a planar direction of the powder 200 and the surface become substantially parallel to each other (see FIGS. 3A and 3B).

The recording medium S to which the powder 200 has been supplied by the powder supply device 70 is conveyed to the toner image forming device 10.

In the image reading unit of the toner image forming device 10, light emitted from the light source 11 is emitted to a document placed on a reading surface, and the reflected light forms an image on the imaging element 13 which has moved to a reading position via a lens and a reflecting mirror in the optical system 12. The imaging element 13 generates an electric signal depending on the intensity of reflected light from the document. The generated electric signal is converted from an analog signal into a digital signal in the image processing unit 14, then subjected to correction processing, filter processing, image compression processing, and the like, and is stored as image data in a memory of the image processing unit 14. In this way, the image reading unit reads an image of the document and stores the image data.

In the image forming unit, the photosensitive drum 21 rotates at a predetermined speed by a drum motor. The charging unit 22 charges a surface of the photosensitive drum 21 to a desired potential. The optical writing unit 23 writes an image information signal on the photosensitive drum 21 based on the image data, and forms a latent image based on the image information signal on the photosensitive drum 21. Then, the latent image is developed by the developing device 24, and a coated toner image, which is a visible image, is formed on the photosensitive drum 21. In this way, unfixed coated toner images of yellow, magenta, cyan, and black are formed on the photosensitive drums 21 of the Y, M, C, and K image forming units, respectively. Thus, the image forming unit forms the coated toner image using an electrophotographic image forming process.

The coated toner images of the respective colors formed by the Y, M, C, and K image forming units are sequentially transferred onto the traveling intermediate transfer belt 26 by a primary transfer unit. In this way, a color toner image in which yellow, magenta, cyan, and black toner layers are superimposed is formed on the intermediate transfer belt 26.

In the recording medium conveying unit, the recording medium S is fed one by one from the sheet feeding trays 41, 42, and 43 of the sheet feeding unit to a conveying path by the feeding roller 31 and the separating roller 32. The recording medium S fed to the conveying path is conveyed to a secondary transfer roller via the loop roller 34 and the resist roller 35 by the conveying roller 33 along the conveying path. Then, the coated toner image on the intermediate transfer belt 26 is transferred onto the recording medium S.

The fixing unit 27 applies heat and pressure to the recording medium S to which the coated toner image has been transferred. As a result, the coated toner image on the recording medium S is fixed to the recording medium S as an image by a coated toner. In this way, the image by a coated toner is prepared on the recording medium S. The recording medium S on which the image by a coated toner has been formed is discharged to the outside via the sheet discharging roller 36.

Incidentally, the recording medium S to which the image has been fixed is guided to the sheet inverting unit 37, and the recording medium S can be discharged while the front and back sides of the recording medium S are inverted. As a result, images can be formed on both surfaces of the recording medium S.

Therefore, in a final image, a metallic tone or pearl tone appearance is obtained as an appearance in which a visual effect by the layer of the powder 200 and a visual effect of an image (base image) by the recording medium S and a coated toner layer are combined.

Figure 4:
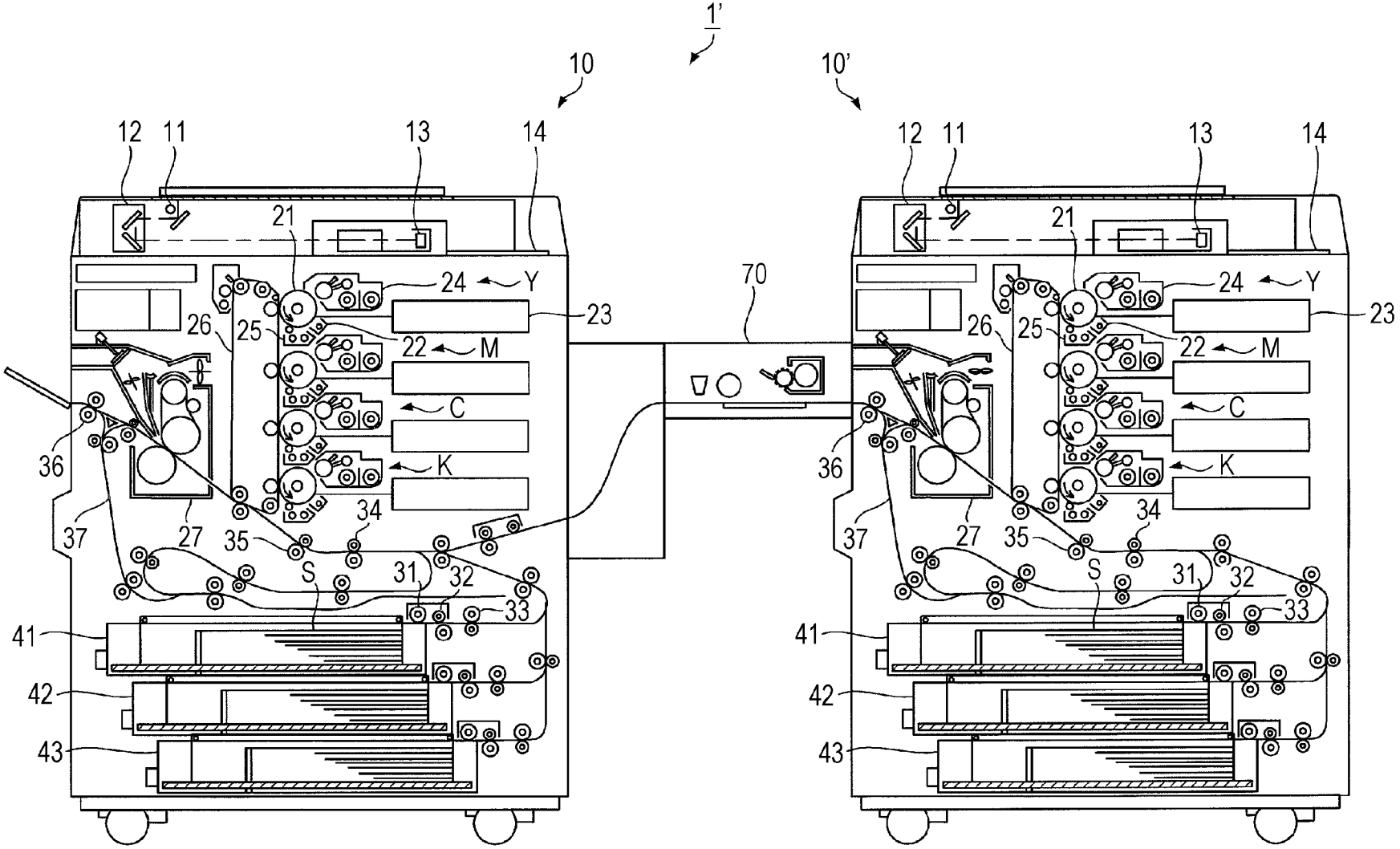
FIG. 4 is a view illustrating the configuration of an image forming device in another embodiment.

FIG. 4 is a schematic view of an image forming device according to another embodiment. As illustrated in FIG. 4, an image forming device 1' according to another embodiment further includes a resin image forming device that forms a resin image on a recording medium S in addition to a powder supply device 70, a toner supply device, and a fixing device. As the resin image forming device, a known device can be used as long as being able to form a resin image on the recording medium S. In the present embodiment, an example will be described in which an image forming unit mounted on a general toner image forming device (first toner image forming device 10') is used as the resin image forming device.

As illustrated in FIG. 4, the image forming device 1' according to another embodiment includes the first toner image forming device 10', the powder supply device 70, and a second toner image forming device 10.

The first toner image forming device 10' and the second toner image forming device 10 have a similar configuration to the above-described toner image forming device. The powder supply device 70 in the image forming device 1' according to the present embodiment further includes a heater.

The first toner image forming device 10' forms a resin image in a powder supply region similarly to the above-described coated toner layer. The recording medium S on which a resin image has been formed is conveyed to the powder supply device 70. The resin image on the recording medium S is heated from the back surface of the recording medium S by the heater. By this heating, the resin image is moderately softened, and an adhesive force is generated on a surface of the resin image. Next, a powder 200 is supplied onto the recording medium S by a flicker 98*d*, and the powder 200 is rubbed by a rubbing roller 74. A surplus of the powder 200 is sucked by a powder collector due to a flow of air by the powder collector, and is removed from the recording medium S and the conveying path.

The recording medium S on which the resin image has been formed and to which the powder 200 has been supplied is conveyed to the second toner image forming device 10. As described above, an image by a coated toner is formed on the recording medium S conveyed to the second toner image forming device 10. The recording medium S on which the image by a coated toner has been formed is discharged to the outside.

Incidentally, in each of the above-described image forming devices 1 and 1', the powder supply device, the toner supply device, and the fixing device are connected to one another, but may be separated from one another. Alternatively, for example, the powder supply device, the toner supply device, and the fixing device may be configured as an integrated device.

EXAMPLES

The present invention will be described more specifically with reference to the following Examples and Comparative Examples. Note that the present invention is not limited to the following Examples and the like.

[Preparation of Black Dispersion]

To 160 parts by mass of deionized water, 11.5 parts by mass of sodium n-dodecylsulfate was added, dissolved, and stirred to prepare a surfactant aqueous solution. To the prepared surfactant aqueous solution, 15 parts by mass of a black colorant (carbon black: Mogul L) was gradually added. The resulting mixture was dispersed using "Clear Mix W Motion CLM-0.8" (manufactured by M Technique Co., Ltd., "Clear Mix" is a registered trademark of M Technique Co., Ltd.) to prepare a black dispersion.

The particle diameter of the black colorant in the black dispersion was 220 nm in terms of a volume-based median diameter. Note that the volume-based median diameter was determined by measurement using "MICROTRAC UPA-150" (manufactured by HONEYWELL) under the following measurement conditions.

Sample refractive index: 1.59

Sample specific gravity: 1.05 (in terms of spherical particles)

Solvent refractive index: 1.33

Solvent viscosity: 0.797 (30° C.), 1.002 (20° C.)

0 point adjustment: deionized water was put into a measurement cell for adjustment.

[Preparation of Yellow Dispersion]

A yellow dispersion was prepared in a similar manner to the preparation of the black dispersion except that "C.I. Pigment Yellow 74" was used in place of "Carbon black: Mogul L". The median diameter of a fine particle of the yellow colorant in the yellow dispersion was 140 nm.

[Preparation of Magenta Dispersion]

A magenta dispersion was prepared in a similar manner to the preparation of the black dispersion except that "C.I. Pigment Red 122" was used in place of "Carbon black: Mogul L". The median diameter of a fine particle of the magenta colorant in the magenta dispersion was 130 nm.

[Preparation of Cyan Dispersion]

A cyan dispersion was prepared in a similar manner to the preparation of the black dispersion except that "C.I. Pigment Blue 15:3" was used in place of "Carbon black: Mogul L". The median diameter of a fine particle of the cyan colorant in the cyan dispersion was 110 nm.

[Preparation of Core Resin Particles]

(a) First Stage Polymerization

Into a reaction vessel equipped with a stirrer, a temperature sensor, a cooling tube, and a nitrogen introduction device, a surfactant aqueous solution 1 in which 4 parts by mass of sodium polyoxyethylene-2-dodecyl ether sulfate was dissolved in 3040 parts by mass of deionized water was put. Subsequently, while the surfactant aqueous solution 1 was stirred at a stirring speed of 230 rpm under a nitrogen stream, the temperature of the surfactant aqueous solution 1 was raised to 80° C.

A polymerization initiator solution 1 obtained by dissolving 10 parts by mass of potassium persulfate in 400 parts by mass of deionized water was added to the surfactant aqueous solution 1, and the temperature of the resulting mixture was raised to 75° C. Thereafter, a monomer mixture 1 containing the following components in the following amounts was added dropwise to the mixture over one hour.

Styrene: 532 parts by mass n-Butyl acrylate: 200 parts by mass

Methacrylic acid: 68 parts by mass n-Octyl mercaptan: 16.4 parts by mass

After the monomer mixture 1 was added dropwise, the resulting reaction liquid was heated and stirred at 75° C. for two hours, and polymerization (first stage polymerization) was thereby performed to prepare resin particles A1.

(b) Second Stage Polymerization

Into a flask equipped with a stirrer, a monomer mixture 2 containing the following components in the following amounts was put, and 93.8 parts by mass of paraffin wax "HNP-57" (manufactured by Nippon Seiro Co., Ltd.) as a release agent was added thereto. The resulting mixture was heated to 90° C. for dissolution.

Styrene: 101.1 parts by mass n-Butyl acrylate: 62.2 parts by mass

Methacrylic acid: 12.3 parts by mass n-Octyl mercaptan: 1.75 parts by mass

Meanwhile, a surfactant aqueous solution 2 obtained by dissolving 3 parts by mass of sodium polyoxyethylene-2-dodecyl ether sulfate in 1560 parts by mass of deionized water was prepared and heated to 98° C. To the surfactant aqueous solution 2, 32.8 parts by mass of the resin particles A1 were added, and the monomer mixture 2 was further added. Thereafter, the resulting mixture was mixed and dispersed for eight hours using a mechanical dispersing machine "CLEARMIX" having a circulation path (manufactured by M Technique Co., Ltd.). By performing mixing and dispersing in this way, an emulsified particle dispersion 1 containing an emulsified particle having a dispersed particle diameter of 340 nm was prepared.

Subsequently, a polymerization initiator solution 2 obtained by dissolving 6 parts by mass of potassium persulfate in 200 parts by mass of deionized water was added to the emulsified particle dispersion 1. The resulting mixture was heated and stirred at 98° C. for 12 hours, and polymerization (second stage polymerization) was thereby performed to prepare resin particles A2 and to obtain a dispersion containing the resin particles A2.

(c) Third Stage Polymerization

A polymerization initiator solution 3 obtained by dissolving 5.45 parts by mass of potassium persulfate in 220 parts by mass of deionized water was added to the dispersion containing the resin particles A2. To the resulting dispersion, a monomer mixture 3 containing the following components in the following amounts was added dropwise over one hour under a temperature condition of 80° C.

Styrene: 293.8 parts by mass n-Butyl acrylate: 154.1 parts by mass n-Octyl mercaptan: 7.08 parts by mass After completion of the dropwise addition, the resulting mixture was heated and stirred for two hours, and polymerization (third stage polymerization) was thereby performed. After completion of the polymerization, the resulting liquid was cooled to 28° C. to prepare core resin particles.

[Preparation of Shell Resin Particles]

By performing a polymerization reaction and a treatment after the reaction similarly except that the monomer mixture 1 used in the first stage polymerization in the preparation of the core resin particles was changed to a monomer mixture 4 containing the following components in the following amounts, shell resin particles were prepared.

Styrene: 624 parts by mass

2-Ethylhexyl acrylate: 120 parts by mass

Methacrylic acid: 56 parts by mass n-Octyl mercaptan: 16.4 parts by mass

[Preparation of Black Toner Particles]

(a) Preparation of Core Portion

Into a reaction vessel equipped with a stirrer, a temperature sensor, a cooling tube, and a nitrogen introduction device, the following components were put in the following amounts and stirred. The temperature of the resulting mixture was adjusted to 30° C. Thereafter, a 5 mol/L sodium hydroxide aqueous solution was added to the mixture, and the pH thereof was adjusted to 8 to 11.

Core resin particles: 420.7 parts by mass

Deionized water: 900 parts by mass

Black dispersion: 300 parts by mass

Subsequently, to the mixture, an aqueous solution obtained by dissolving 2 parts by mass of magnesium chloride hexahydrate in 1000 parts by mass of deionized water was added at 30° C. over 10 minutes under stirring. The resulting mixture was left for three minutes. Thereafter, the temperature of the mixture was started to be raised and raised to 65° C. over 60 minutes to associate particles in the mixture with one another. In this state, the particle diameters of the associated particles were measured using a particle size distribution measuring device "Multisizer 3" (manufactured by Coulter, Inc.). When the volume-based median diameter of each of the associated particles reached 5.8 μm, an aqueous solution obtained by dissolving 40.2 parts by mass of sodium chloride in 1000 parts by mass of deionized water was added to the mixture to stop the association of the particles.

After the association was stopped, furthermore, as an aging treatment, the resulting liquid was heated and stirred at a liquid temperature of 70° C. for one hour, and fusion of the associated particles was thereby continued to prepare a core portion. The average circularity of the core portion was measured with a wet flow type particle diameter/shape analyzer "FPIA 2100" (manufactured by Sysmec Corporation, "FPIA" is a registered trademark of Sysmec Corporation), and the average circularity was 0.912.

(b) Preparation of Shell

Next, the temperature of the mixture was set to 65° C., and 50 parts by mass of the shell resin particles were added to the mixture. To the mixture, an aqueous solution obtained by dissolving 2 parts by mass of magnesium chloride hexahydrate in 1000 parts by mass of deionized water was further added over 10 minutes. Thereafter, the temperature of the mixture was raised to 70° C., and the mixture was stirred for one hour. In this way, shell resin particles were fused to a surface of the core portion. Thereafter, the resulting liquid was subjected to an aging treatment at 75° C. for 20 minutes to form a shell.

Thereafter, an aqueous solution obtained by dissolving 40.2 parts by mass of sodium chloride in 1000 parts by mass of deionized water was added to the resulting liquid to stop the formation of the shell. Furthermore, the resulting liquid was cooled to 30° C. at a rate of 8° C./min. The manufactured particles were filtered, repeatedly washed with deionized water at 45° C., and dried with warm air at 40° C. to prepare black toner base particles each having a shell covering a surface of the core portion.

(c) External Additive Adding Step

The following external additives were added to the black toner base particles, and the resulting mixture was subjected to an external addition treatment using a "Henschel mixer" (manufactured by Nippon Coke & Engineering Co., Ltd.) to prepare black toner particles.

Hexamethylsilazane-treated silica fine particles: 0.6 parts by mass n-Octylsilane-treated titanium dioxide fine particles: 0.8 parts by mass Note that the external addition treatment using a Henschel mixer was performed under conditions of a peripheral speed of a stirring blade of 35 m/sec, a treatment temperature of 35° C., and a treatment time of 15 minutes. The particle diameter of each of the silica fine particles of the external additive was 12 nm in terms of a volume-based median diameter. The particle diameter of each of the titanium dioxide fine particles was 20 nm in terms of a volume-based median diameter. Through the above steps, black toner particles were prepared.

[Preparation of Yellow Toner Particles]

Yellow toner particles were prepared in a similar manner to the preparation of the black toner particles except that a yellow dispersion was used in place of the black dispersion.

[Preparation of Magenta Toner Particles]

Magenta toner particles were prepared in a similar manner to the preparation of the black toner particles except that a magenta dispersion was used in place of the black dispersion.

[Preparation of Cyan Toner Particles]

Cyan toner particles were prepared in a similar manner to the preparation of the black toner particles except that a cyan dispersion was used in place of the black dispersion.

[Preparation of Clear Toner Particles 1]

Clear toner particles 1 were prepared in a similar manner to the preparation of the black toner particles except that a surfactant aqueous solution obtained by mixing 18.5 parts by mass of sodium n-dodecylsulfate with 281.5 parts by mass of deionized water was used in place of the black dispersion.

[Preparation of Clear Toner Particles 2]

Clear toner particles 2 were prepared in a similar manner to the preparation of the black toner particles except that a surfactant aqueous solution obtained by mixing 18.5 parts by mass of sodium n-dodecylsulfate with 281.5 parts by mass of deionized water was used in place of the black dispersion and that 5 mL of a 1 mol/L sodium hydroxide aqueous solution was added before cooling after formation of the shell.

[Preparation of Developer]

With the black toner particles, the yellow toner particles, the magenta toner particles, the cyan toner particles, the clear toner particles 1, and the clear toner particles 2, ferrite carrier particles having surfaces coated with a copolymer of methyl methacrylate and cyclohexyl methacrylate and having a volume average particle diameter of 40 μm were mixed in an amount such that a toner concentration was 6% by mass to prepare a black developer, a yellow developer, a magenta developer, a cyan developer, a clear developer 1, and a clear developer 2, respectively.

EXAMPLES AND EVALUATION

Example 1

Mirror powder D-9 chromium powder manufactured by Sunshine Babe Co. was sprayed on a POD gross coat (basis weight: 128 g/m$^2$) manufactured by Oji Paper Co., Ltd. using a metal mesh having an opening of 100 μm. Using a digital microscope VHX-6000 manufactured by Keyence Corporation, a photograph was taken at a magnification of 100 times, and binarization was performed with LUSEX-AP manufactured by Nireco Corporation. Subsequently, a covering ratio by the powder with respect to a powder supply region was calculated.

(Evaluation of Metallic Feeling)

A cyan solid image of 2 cm×2 cm was output so as to overlap with the image of 2 cm×2 cm obtained above using Accurio Press C2070 manufactured by Konica Minolta Japan, Inc. Evaluation was performed based on whether or not 10 subjects perceived a metallic feeling by visual observation. A color tone was also observed.

(Evaluation of Fixability)

The surface of the image on which a metallic feeling had been evaluated was rubbed with a brush roller at a pressing force of 100 kPa for 30 seconds (deterioration test). Using a digital microscope VHX-6000 manufactured by Keyence Corporation, a photograph of the image after the deterioration test was taken at a magnification of 100 times, and binarization was performed with LUSEX-AP manufactured by Nireco Corporation. Fixability was evaluated by calculating a peeling ratio based on the following formulas (1) to (3).

Peeling ratio between recording medium and powder=100−(covering ratio by powder after deterioration test with respect to powder supply region/covering ratio by powder after powder supply with respect to powder supply region)×100 Formula (1)

Peeling ratio between powder and coated image=100−(covering ratio by coated image after deterioration test with respect to powder/covering ratio by powder after deterioration test with respect to powder supply region)×100 Formula (2)

Peeling ratio=peeling ratio between recording medium and powder+peeling ratio between powder and coated image Formula (3)

Example 2

A black solid image was output as a resin image on a POD gross coat (basis weight 128 g/m$^2$) manufactured by Oji Paper Co., Ltd using Accurio Press C2070 manufactured by Konica Minolta Japan, Inc. Thereafter, mirror powder D-9 chromium powder manufactured by Sunshine Babe Co. was sprayed thereon using a metal mesh having an opening of 100 μm. Using a digital microscope VHX-6000 manufactured by Keyence Corporation, a photograph was taken at a magnification of 100 times, and binarization was performed with LUSEX-AP manufactured by Nireco Corporation. Subsequently, a covering ratio by the powder with respect to a powder supply region was calculated. Evaluation of a metallic feeling was performed in a similar manner to Example 1. A peeling ratio in the evaluation of fixability was calculated based on the following formulas (4) to (6).

Peeling ratio between resin image and powder=100−(covering ratio by powder after deterioration test with respect to resin image region/covering ratio by powder after powder supply with respect to resin image region)×100 Formula (4)

Peeling ratio between powder and coated image=100−(covering ratio by coated image after deterioration test with respect to powder/covering ratio by powder after deterioration test with respect to resin image region)×100 Formula (5)

Peeling ratio=peeling ratio between resin image and powder+peeling ratio between powder and coated image Formula (6)

Example 3

A black solid image was output as a base image on a POD gross coat (basis weight 128 g/m$^2$) manufactured by Oji Paper Co., Ltd using Accurio Press C2070 manufactured by Konica Minolta Japan, Inc. Thereafter, while the image was heated at 80° C. with a hot plate, the image was rubbed at a pressing force of 10 kPa using a sponge to which mirror powder D-9 chromium powder manufactured by Sunshine Babe Co. was attached (rubbing step). Using a digital microscope VHX-6000 manufactured by Keyence Corporation, a photograph was taken at a magnification of 100 times, and binarization was performed with LUSEX-AP manufactured by Nireco Corporation. Subsequently, a covering ratio by the powder with respect to a powder supply region was calculated. Evaluation of a metallic feeling was performed in a similar manner to Example 1. A peeling ratio in the evaluation of fixability was calculated based on the following formulas (7) to (9).

Peeling ratio between recording medium and powder=100−(covering ratio by powder after deterioration test with respect to powder supply region/covering ratio by powder after rubbing step with respect to powder supply region)×100 Formula (7)

Peeling ratio between powder and coated image=100−(covering ratio by coated image after deterioration test with respect to powder/covering ratio by powder after deterioration test with respect to powder supply region)×100 Formula (8)

Peeling ratio=peeling ratio between recording medium and powder+peeling ratio between powder and coated image Formula (9)

Example 4

A black solid image was output as a base image on a POD gross coat (basis weight 128 g/m$^2$) manufactured by Oji Paper Co., Ltd using Accurio Press C2070 manufactured by Konica Minolta Japan, Inc. Thereafter, while the image was heated at 80° C. with a hot plate, the image was rubbed at a pressing force of 10 kPa using a sponge to which mirror powder D-9 chromium powder manufactured by Sunshine Babe Co. was attached. After cooling, a part of the attached powder was rubbed with a brush roller at a pressing force of 10 kPa to be removed. A covering ratio was calculated in a similar manner to that in Example 3. Evaluation of a metallic feeling was performed in a similar manner to Example 1. Evaluation of fixability was performed in a similar manner to that in Example 3.

Example 5

A black solid image was output as a base image on a POD gross coat (basis weight 128 g/m$^2$) manufactured by Oji Paper Co., Ltd using Accurio Press C2070 manufactured by Konica Minolta Japan, Inc. Thereafter, while the image was heated at 80° C. with a hot plate, the image was rubbed at a pressing force of 10 kPa using a sponge to which mirror powder D-9 chromium powder manufactured by Sunshine Babe Co. was attached. Thereafter, the temperature of the image was raised to 100° C., and the image was rubbed at a pressing force of 10 kPa using a sponge to which mirror powder D-9 chromium powder manufactured by Sunshine Babe Co. was attached again. A covering ratio was calculated in a similar manner to that in Example 3. Evaluation of a metallic feeling was performed in a similar manner to Example 1. Evaluation of fixability was performed in a similar manner to that in Example 3.

Example 6

A black solid image was output as a base image on a POD gross coat (basis weight 128 g/m$^2$) manufactured by Oji Paper Co., Ltd using Accurio Press C2070 manufactured by Konica Minolta Japan, Inc. Thereafter, while the image was heated at 80° C. with a hot plate, the image was rubbed at a pressing force of 10 kPa using a sponge to which mirror powder D-9 chromium powder manufactured by Sunshine Babe Co. was attached. After cooling, a part of the attached powder was rubbed with a brush roller at a pressing force of 30 kPa. A covering ratio was calculated in a similar manner to that in Example 3. Evaluation of a metallic feeling was performed in a similar manner to Example 1. Evaluation of fixability was performed in a similar manner to that in Example 3.

Example 7

A black solid image of 2 cm×2 cm was output as a base image on a POD gross coat (basis weight 128 g/m$^2$) manufactured by Oji Paper Co., Ltd using Accurio Press C2070 manufactured by Konica Minolta Japan, Inc. Thereafter, while the image was heated at 80° C. with a hot plate, the image was rubbed at a pressing force of 10 kPa using a sponge to which mirror powder D-9 chromium powder manufactured by Sunshine Babe Co. was attached. Thereafter, the temperature of the image was raised to 100° C., and the image was rubbed at a pressing force of 10 kPa using a sponge to which mirror powder D-9 chromium powder manufactured by Sunshine Babe Co. was attached again. Thereafter, the temperature of the image was raised to 120° C., and the image was rubbed at a pressing force of 10 kPa using a sponge to which mirror powder D-9 chromium powder manufactured by Sunshine Babe Co. was attached again. A covering ratio was calculated in a similar manner to that in Example 3. Evaluation of a metallic feeling was performed in a similar manner to Example 1. Evaluation of fixability was performed in a similar manner to that in Example 3.

Example 8

Evaluation was performed in a similar manner to Example 3 except that a red solid image (yellow solid+magenta solid image) was used in place of the black solid image of Example 3. The evaluation result was the same, but it was confirmed that the color tone was red and that the color tone could be changed.

Example 9

Evaluation was performed in a similar manner to Example 3 except that a solid image using the clear toner 1 was used in place of the black solid image of Example 3. The evaluation result was the same, but it was confirmed that the color tone was the same as that before the coated fixed image was formed.

Example 10

Evaluation was performed in a similar manner to Example 3 except that a solid image using the clear toner 2 was used in place of the black solid image of Example 3. As a result of the evaluation, it was confirmed that the color tone was the same as that before the coated fixed image was formed but that a matte metallic feeling was obtained.

Table 1 illustrates a covering ratio, an evaluation result of a metallic feeling, an evaluation result of fixability, and remarks.

TABLE 1

| | Covering ratio (%) | Metallic feeling (the number of subjects) | Fixability (peeling ratio) (%) | Color tone, Glossiness |
|---|---|---|---|---|
| Example 1 | 65 | 8 | 9 | Cyan |
| Example 2 | 63 | 9 | 7 | Cyan |
| Example 3 | 62 | 10 | 4 | Cyan |

TABLE 1-continued

| | Covering ratio (%) | Metallic feeling (the number of subjects) | Fixability (peeling ratio) (%) | Color tone, Glossiness |
|---|---|---|---|---|
| Example 4 | 43 | 8 | 2 | Cyan |
| Example 5 | 87 | 10 | 7 | Cyan |
| Example 6 | 37 | 6 | 1 | Cyan |
| Example 7 | 92 | 10 | 9 | Cyan |
| Example 8 | 62 | 10 | 4 | Red |
| Example 9 | 62 | 10 | 4 | No color tone |
| Example 10 | 62 | 10 | 4 | No color tone, Glossiness: matte |

[Result]

As illustrated in Table 1, in each of Examples 1 to 10, a final image having a metallic tone was obtained. In addition, each of Examples 1 to 10 had fixability. From these Examples, it is found that an image having a metallic tone can be properly obtained by forming an image by a coated toner after a powder is supplied to a recording medium.

According to the present invention, an image exhibiting an appearance having a metallic tone can be formed at a desired position. An image exhibiting an appearance having a metallic tone can be formed by an electrophotographic image forming device. Therefore, according to the present invention, it is expected to further spread formation of an image exhibiting the above special appearance.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming method comprising:

supplying a powder onto a recording medium;

supplying a coated toner onto the powder on the recording medium; and fixing the powder to the recording medium by heating the coated toner supplied onto the powder and melting the coated toner, wherein the supplying the powder includes:

placing the powder on a softened resin image disposed on the recording medium.

2. The image forming method according to claim 1, wherein a covering ratio by the powder with respect to a region to which the powder is to be supplied is 40 to 90% in the supplying the powder.

3. The image forming method according to claim 1, wherein the supplying the powder further includes:

rubbing the placed powder.

4. The image forming method according to claim 1, further comprising forming a resin image on the recording medium before the supplying the powder.

5. The image forming method according to claim 3, wherein in the rubbing the powder, the powder is rubbed in a state where a straight line in a conveyance direction of the recording medium crosses a straight line in a long axis direction of a rubbing member that rubs the powder.

6. The image forming method according to claim 5, wherein in the rubbing the powder, the rubbing member is reciprocated in an orientation direction of the powder.

7. The image forming method according to claim 5, wherein the rubbing member has deformation followability.

8. The image forming method according to claim 5, wherein the rubbing member is a sponge.

9. The image forming method according to claim 1, further comprising collecting the powder after the supplying the powder and before the supplying the coated toner.

10. The image forming method according to claim 1, wherein the powder has a non-spherical shape.

11. The image forming method according to claim 1, wherein the powder has a flat shape.

12. The image forming method according to claim 1, wherein the powder has a thickness of 0.2 to 15 μm.

13. The image forming method according to claim 1, wherein the powder contains a metal powder.

14. The image forming method according to claim 1, wherein both the resin image formed on the recording medium and an image by the coated toner formed on the powder are formed by a dry electrophotographic method.

15. An image forming device comprising:

a powder supply device that supplies a powder onto a recording medium;

a toner supply device that supplies a coated toner onto the powder on the recording medium; and a fixing device that fixes the powder to the recording medium by heating the coated toner supplied onto the powder and melting the coated toner, wherein the powder supply device includes:

a placement device that places a powder on a softened resin image disposed on the recording medium.

16. The image forming device according to claim 15, wherein the powder supply device further includes:

a rubbing device that rubs the placed powder from above the powder.

17. The image forming device according to claim 15, wherein the powder supply device, the toner supply device, and the fixing device can be connected to and separated from one another.

18. An image forming method comprising:

supplying a powder onto a recording medium;

collecting the powder after the supplying the powder;

after the collecting the power, supplying a coated toner onto the powder on the recording medium; and fixing the powder to the recording medium by heating the coated toner supplied onto the powder and melting the coated toner.

* * * * *